United States Patent [19]

Huostila et al.

[11] 4,238,284

[45] Dec. 9, 1980

[54] METHOD FOR DEWATERING A TISSUE WEB

[75] Inventors: Markku Huostila, Nokia; Timo Haapsaari, Keski-Palokka; Matti Suokas; Risto Turunen, both of Jyväskylä, all of Finland

[73] Assignee: Oy Nokia Ab & Valmet Oy, Finland

[21] Appl. No.: 922,275

[22] Filed: Jul. 6, 1978

[30] Foreign Application Priority Data

Jul. 8, 1977 [FI] Finland ..... 772150

[51] Int. Cl.[3] ..... D21F 5/14

[52] U.S. Cl. ..... 162/207; 34/16; 162/290; 162/306

[58] Field of Search ..... 162/207, 290, 306, 359, 162/364; 34/16, 23, 115, 116, 117, 123

[56] References Cited

U.S. PATENT DOCUMENTS

| | | | |
|---|---|---|---|
| 2,537,129 | 1/1951 | Goodwillie | 162/359 X |
| 3,303,576 | 2/1967 | Sisson | 162/207 X |
| 3,560,333 | 2/1971 | Douglas et al. | 162/207 |
| 3,816,941 | 6/1974 | Holik et al. | 34/116 |
| 3,821,068 | 6/1974 | Shaw | 162/290 X |
| 4,036,684 | 7/1977 | Schmitt et al. | 162/306 |
| 4,055,461 | 10/1977 | Turunen | 162/290 |

OTHER PUBLICATIONS

Gardiner et al., "Advances in Flow-Through Drying Techniques", *Das Papier,* vol. 30:10A, 1976, pp. V118–V127.

*Primary Examiner*—Richard V. Fisher
*Attorney, Agent, or Firm*—Steinberg & Blake

[57] ABSTRACT

In a tissue paper making machine, a method for dewatering a tissue web without wet pressing and transferring the web onto a flow through drying cylinder including conducting a tissue web onto a pick-up fabric formed of felt and dewatering the web, without wet pressing, into the pick-up felt through the application of suction and capillary forces until the web has sufficient dry matter content to be passed to a flow through drying cylinder. The web is transferred to a flow through wire which passes over the web carrying pick-up felt at a suction roller by the application of suction over a narrow zone, the web being secured to the flow through wire by the application of additional suction over a broader suction zone.

4 Claims, 2 Drawing Figures

METHOD FOR DEWATERING A TISSUE WEB

BACKGROUND OF THE INVENTION

This invention relates generally to tissue paper machines, and more particularly, to a method for use in connection with tissue paper machines for dewatering a web prior to passing it to a flow through drying cylinder.

In the past in order to dewater a paper web so that it has a sufficiently high dry matter content, the web has been commonly subjected to a wet pressing operation, i.e., has been directed through press rollers located in front of the flow through dryer. However, this has not been entirely satisfactory in tissue paper making since such wet pressing reduces the desirable bulkiness, softness, and absorbing capacity required of tissue paper. In order to overcome this problem, various types of suction apparatus had been employed in conjunction with wire fabric transfer systems in order to ensure sufficient dry matter content in the web without using wet pressing. However, this method is also not entirely satisfactory for the reason that the use of suction energy for removing water from the web is unusually uneconomic.

Recently, flow through dryers have gained wide spread use in tissue paper machines. Such flow through dryers are conventional and generally comprise a drying cylinder having a perforated flow through mantel and a surrounding hood in which an overpressure is provided. The interior of the flow through drying cylinder is provided with vacuum apparatus such that hot drying gases are drawn from the hood through the web and cylinder mantel to the drying cylinder interior. As is known, the flow through drying apparatus may be designed to provide flow of hot gases from the cylinder to the hood.

Where flow through drying is used in tissue paper making machines, wet pressing of the web is usually avoided in order to maintain the softness, bulkiness and absorbing capacity required of tissue paper.

Thus, tissue paper machines are known which include large diameter flow through drying cylinders and subsequent creping cylinders from which the web is removed by creping scrapers in a known fashion. Tissue paper machines are also known which include conventional yankee cylinders and subsequent flow through cylinders which act as after dryers. For example, reference is made to the article "Fortschritte in der Durchstromtrockungstechnik" in "Das Papier", Number 10a 1976, pages 118 to 127.

According to previously known methods, a web is transferred from the former wire to the flow through drying cylinder by wires which function not only to transport the web from the former section to the drying cylinder but which also function as a flow through drying wire which conducts the web over one or more flow through drying cylinders. However, it has been found that in the use of such wires as transfer fabrics, a problem has arisen in that washing water often splashes over from the wire onto the web. Additionally, it has been found that water droplets which fall on the wire fabric may result in deleterious stains in the paper.

Where such wires are used in transporting the web from the former section to the flow through drying cylinder, it is necessary to provide a relatively high suction through the wire in order to ensure adequate adherence of the web against the wire.

In such cases, water is drawn from the web through the wire where it is removed by the suction air current. Where the magnitude of the suction is decreased, it is then necessary to provide the lower suction forces over a proportionately greater distance in order to ensure a sufficiently long relation of the suction so that the water is drawn from the web through the wire. In both cases, namely, high suction over a short distance or lower suction over a proportionately larger distance, large quantities of air are required.

Reference is made to U.S. Pat. Nos. 3,303,576 and 3,821,068 which relate generally to the present subject matter. Reference is also made to copending U.S. application Ser. No. 922,274 filed simultaneously herewith and assigned to the same assignee as the present application, which discloses subject matter generally related to the present subject matter.

SUMMARY OF THE INVENTION

Accordingly, one object of the present invention is to provide a new and improved method for dewatering a tissue paper web prior to drying in a flow through dryer.

Another object is to provide such a method without the necessity of a pressing operation.

Still another object is to provide such a method wherein high level suction is not required during the web dewatering.

Briefly, in accordance with these and other objects, a method is employed in a tissue paper making machine having a flow through drying cylinder wherein a tissue web is conducted onto a pick up fabric which is formed of felt. The web carried by the pick up felt is dewatered by means of suction and capillary forces in such quantities that the tissue web has a sufficiently high dry matter content that it may then be passed, after transfer to a flow through drying wire, over the flow through drying cylinder.

The method of the present invention is based on the fact that the felt material of the pick-up fabric absorbs by capillary action water from the web due to the capillary structure of the felt. This is in direct contradistinction to prior pick-up fabrics formed of wire from which water readily travels toward the web. When felt is used for the pick-up fabric in accordance with the invention, it may, after washing, be dried with a vacuum dryer known in the art and, after having been covered, pass again to the web pick-up point at the former section.

The use of felt for the transfer pick-up fabric in accordance with the invention allows for a lower level suction or vacuum to be used for removing water from the felt and, therefore from the web, due to the fact that the felt fabric is relatively denser than the wire fabric. Thus, in order to obtain the same level of dry matter content in the web, the method of the present invention requires a considerably smaller quantity of air or, in other words, a lower level of suction, thereby resulting in an extremely economical web dewatering. Thus, where a wire pick-up fabric has a net type structure with warps and wefts, a pick-up felt includes in addition to the warps and wefts, separate individual fibers which form a felt material even absent the net type structure. Such felt structure is sufficient to give rise to capillary forces when contacted by the wet web.

DESCRIPTION OF THE DRAWINGS

The invention is illustrated by way of example in the accompanying drawings which form part of this application and in which.

DESCRIPTION OF PREFERRED EMBODIMENTS

Figure 1:
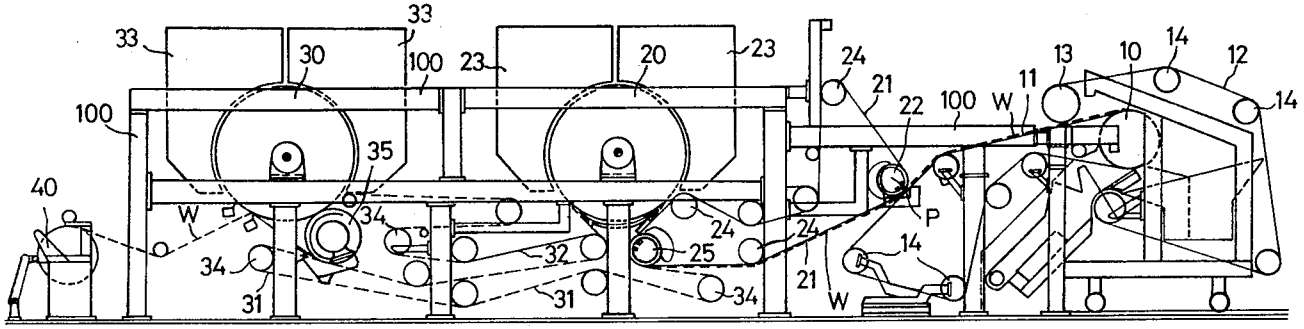
FIG. 1 is a diagrammatic side view of a tissue paper machine employing the method of the present invention.

Referring now to the drawings wherein like reference characters designate identical or corresponding parts throughout the several view and more particularly to FIG. 1, a tissue paper machine is illustrated having a web forming section which includes a forming cylinder 10, a carrying wire 11, a covering wire 12 and a fold roller 13. Carrying wire 11 and covering wire 12 define a double wire section of the initial stage of the forming section terminating at fold roller 13. Subsequent to this point, carrying wire 11 transports web W to a point, designated P, whereupon web W is transferred to pick-up fabric 21 by a pick-up roller 22. According to the present invention, pick-up fabric 21 comprises felt material.

Carrying wire 11 and covering wire 12 are guided by lead-in rollers 14. The frame elements of the paper machine are generally designated 100. The pick-up felt 21 is guided by lead-in rollers 24.

It is understood that other configurations of the former section may be utilized in connection with the present invention. For example, a former disclosed in U.S. Pat. No. 4,055,461 may be employed in conjunction with the method of the present invention.

The web carrying pick-up felt 21 engages a drawing roller 25 equipped with a suction zone, described hereinbelow.

A flow through dryer is employed including a flow through drying cylinder 20 having an air pervious mantel, a substantial portion of which is covered by a hood 23 provided with an overpressure therewithin.

A flow through drying wire 31 guided by rolls 34 surrounds the flow through drying cylinder 20. Web W is transferred from pick-up felt 21 onto flow through drying wire 31 at roller 25 where the flow through drying wire 31 passes over web W carried on pick-up felt 21. Hot gases are drawn or sucked from the interior of hood 23 through web W carried on flow through dryer wire 31 into the interior of the flow through drying cylinder 20 which is connected to a suction pump by conventional apparatus. Such flow through dryers are conventional and will not be described in detail.

Subsequent to passing over drying cylinder 20, web W is transferred onto transfer fabric 32 which transports the web to a roller 35 which, together with yankee cylinder 30, defines a press. The yankee cylinder 30 is equipped with a hood 33 as is conventional. Web W is detached from yankee cylinder 30 by conventional means, such for example as a creping scraper, and is subsequently wound onto a rolling device 40.

Figure 2:
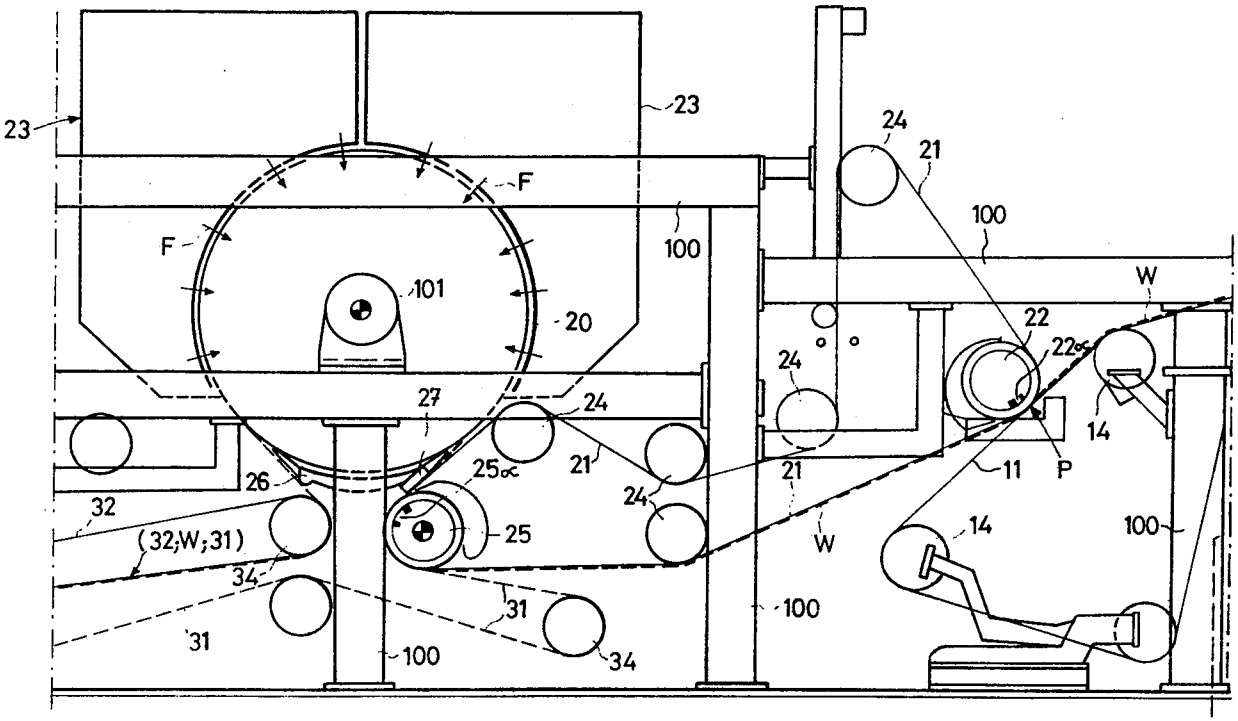
FIG. 2 is a diagrammatic side view of a portion of the tissue paper machine illustrated in FIG. 1.

Referring now to FIG. 2, it is seen that web W traverses a relatively long run from pick-up roll 22, which is equipped with a suction zone 22$\alpha$, to drawing roller 25, which is equipped with a vacuum zone 25$\alpha$. Of course, during this run, web W is carried by pick-up felt 21. During its run on pick-up felt 21, water is removed from web W into felt 21 predominantly due to the capillary properties of the felt, discussed above. Thus, dewatering of the web occurs during the webs travel on the pick-up felt 21. The water absorbed by pick-up felt 21 is removed by felt aspirators or vacuum dryers whereupon felt 21 is redirected to pick-up roller 22 after such reconditioning.

Further dewatering of web W occurs in suction zones 22$\alpha$ and 25$\alpha$ of pick-up roll 22 and drawing roller 25, respectively. It is important, however, that the energy consumed by these suction sectors is relatively low when compared to prior art suction dewatering apparatus. The drawing roller 25 preferably comprises a roller having an extremely pervious surface.

A section of flow through dryer wire 31 passes over that section of the web carrying pick-up felt 21 which engages drawing roller 25. Subsequent to the point of departure from drawing roller 25, the direction of travel of pick-up felt 21 is deviated from the travel direction of flow through drying wire 31. Subsequent to roller 25, suction apparatus 27 is provided against flow through drying wire 31 which applies a vacuum across a narrow vacuum zone which detaches web W from pick-up felt 21 transferring the same to wire 31. A second broader suction zone is applied by apparatus 27 against flow through drying wire 31 extending from the first suction zone to the point of engagement of the drying wire 31 with drying cylinder 20. This second suction zone secures web W to the drying wire 31. A detailed description of the method and apparatus of transferring the web from the pick-up felt 21 to the flow through drying wire 31 is set forth in the above-identified copending patent application Ser. No. 922,274 filed simultaneously herewith.

The vacuum units may be installed within the loop of pick-up felt 21. Further, a regionally closed box or similar arrangement providing an inlet of hot gas, such as air or steam, for heating the web before reaching the flow through drying cylinder may also be installed.

It has been found that the use of a pick-up felt 21 in accordance with the present invention together with the relatively economical levels of suction results in the dry matter content of tissue web W, prior to its reaching flow through drying cylinder 20, being in the range of 22 to 27%. It is noted that such drying level content is attained without any wet pressing of the web. This drying level content is sufficiently high for economical processing of the web.

In the drawing, the bearing housing of flow through drying cylinder 20 is designated 101 and the shutter member which covers the open sector of cylinder 20 not covered by hood 23 is designated 26. The stream of drying gas which flows from hood 23 through web W and flow through wire 31 into cylinder 20 is indicated by arrows F.

Obviously, numerous modifications and variations of the present invention are possible in the light of the above teachings. Therefore, the practice of the invention may vary within the scope of the following claims.

What is claimed is:

1. In a tissue paper making machine, a method for dewatering and transferring a tissue web to a flow through drying cylinder comprising the steps of:

conducting a tissue web onto a pick-up fabric which is formed of felt material having a capillary structure sufficient to give rise to capillary forces when contacted by the tissue web, the felt pick-up fabric lapping at least two suction rolls, at least one of which has an extremely pervious surface;

removing water from the web into the felt pick-up fabric, without web pressing, solely through the application to the web of suction by said suction rolls and capillary forces arising from the contact between the web and the felt pick-up fabric until the web has a dry matter content of about 22 to 27% so that it can be passed to the flow through drying cylinder; and passing said web to the flow through drying cylinder.

2. In a tissue paper machine which includes a flow through wire extending around the flow through drying cylinder, a method for dewatering and transferring a tissue web to the flow through drying cylinder comprising the steps of:

conducting a tissue web onto a pick-up fabric which is formed of felt material having a capillary structure sufficient to give rise to capillary forces when contacted by the tissue web, the felt pick-up fabric lapping at least two suction rolls, at least one of which has an extremely pervious surface;

removing water from the web into the felt pick-up fabric without web pressing, solely through the application to the web of suction by said suction rolls and capillary forces arising from the contact between the web and the felt pick-up fabric until the web has a dry matter content of about 22 to 27% so that it can be passed to the flow through drying cylinder;

passing said web to the flow through drying cylinder;

conducting the web carrying pick-up felt over the suction zone of one of said suction rolls which has an extremely pervious surface; and conducting the flow through wire over the web conducted on said one of said rolls which has an extremely pervious surface.

3. In a tissue paper making machine which includes a flow through wire extending around a flow through drying cylinder, a method for dewatering and transferring a tissue web to the flow through drying cylinder comprising the steps of:

conducting a tissue web onto a pick-up fabric which is formed of felt material having a capillary structure sufficient to give rise to capillary forces when contacted by the tissue web, the felt pick-up fabric lapping at least two suction rolls, at least one of which has an extremely pervious surface;

removing water from the web into the felt pick-up fabric, without web pressing, solely through the application to the web of suction by said suction rolls and capillary forces arising from the contact between the web and the felt pick-up fabric until the web has a dry matter content of about 22 to 27% so that it can be passed to the flow through drying cylinder;

passing said web to the flow through drying cylinder;

passing a section of the flow through wire onto the web carried by the pick-up felt;

transferring the web from the pick-up felt to the flow through wire by applying a first suction on the web through the flow through wire at said wire section; and deviating the direction of travel of the pick-up felt from the direction of travel of the flow through drying wire.

4. A method as recited in claim 3 wherein said first suction application step includes applying a high suction on the web through the flow through wire over a narrow suction zone and subsequently applying a second suction on the web through the flow through wire over a longer holding zone extending to the point where the web carrying flow through wire engages the flow through cylinder.

* * * * *